US010272716B2

(12) United States Patent
Salimi et al.

(10) Patent No.: US 10,272,716 B2
(45) Date of Patent: Apr. 30, 2019

(54) PLOTTER APPARATUS AND METHODS FOR DRAWING A POLYGON INSCRIBED WITHIN A CIRCLE

(71) Applicants: Hojjatollah Salimi, Hamedan (IR); Hadi Shiri, Hamedan (IR)

(72) Inventors: Hojjatollah Salimi, Hamedan (IR); Hadi Shiri, Hamedan (IR)

( * ) Notice: Subject to any disclaimer, the term of this patent is extended or adjusted under 35 U.S.C. 154(b) by 239 days.

(21) Appl. No.: 15/485,191

(22) Filed: Apr. 11, 2017

(65) Prior Publication Data

US 2018/0290484 A1 Oct. 11, 2018

(51) Int. Cl.

| | |
|---|---|
| ***B43L 9/10*** | (2006.01) |
| ***B43L 13/24*** | (2006.01) |
| ***B43L 7/00*** | (2006.01) |
| ***B43L 13/00*** | (2006.01) |

(52) U.S. Cl.

CPC ..... *B43L 13/24* (2013.01); *B43L 7/005* (2013.01); *B43L 9/10* (2013.01); *B43L 13/001* (2013.01)

(58) Field of Classification Search

CPC ..... B43L 9/10

USPC ..... 33/18.3, 1 AP, 19.3, 663, 664, 665, 33/558.01, 558.02, 558.04, 558.2, 558.4, 33/558.5

See application file for complete search history.

(56) References Cited

U.S. PATENT DOCUMENTS 441,909 A * 12/1890 Walkup ..... B43L 13/10 33/25.2
829,938 A * 8/1906 Cote ..... B43L 9/08 33/558.02
1,145,369 A * 7/1915 Kaplan ..... G01B 3/56 33/1 AP
1,300,221 A * 4/1919 Mooney ..... G01B 3/16 33/558.01
1,420,175 A * 6/1922 Alonso ..... G01B 3/56 33/1 AP
2,144,604 A * 1/1939 Berger ..... B43L 7/005 33/27.032
2,222,853 A * 11/1940 Neurohr ..... G01B 3/56 33/1 AP
2,507,460 A * 5/1950 Schacht ..... G09B 23/04 33/453
2,513,670 A * 7/1950 Penza ..... B43L 9/16 33/27.03
2,645,021 A * 7/1953 Dierkes ..... B43L 9/08 33/558.02
2,865,106 A * 12/1958 Murdoch ..... B43L 9/08 33/41.4

(Continued)

*Primary Examiner* — Christopher W Fulton

(57) ABSTRACT

A plotter apparatus inscribes a polygon in a circle, and includes a ruler body, a first slider, a second slider, multiple brachiums, and a nib member. The ruler body comprises a knap, and a first ruler groove and a second ruler groove to allow movement of the first slider and the second slider. The brachiums are connected across the ruler body via pivots. The nib member allows the drawing of the circle. A fourth brachium is attached to a predetermined numbered hole on a second and a third brachium as per the number of sides required on the polygon. The length of each side of the polygon is retrieved between the knap and a slider. Cyclic arcs, with the determined length as a length of one side of the polygon, are drawn along the circumference of the circle. The arc intersections on the circle are joined together to define the polygon.

8 Claims, 3 Drawing Sheets

(56) References Cited

U.S. PATENT DOCUMENTS

| | | | | | |
|---|---|---|---|---|---|
| 3,157,953 | A * | 11/1964 | Brier | B25D 5/02 | 33/558.02 |
| 3,224,097 | A * | 12/1965 | Izumi | B43L 13/002 | 33/1 AP |
| 3,271,869 | A * | 9/1966 | Ratner | G01B 3/16 | 33/1 C |
| 3,816,928 | A * | 6/1974 | Fessenden | G01C 21/20 | 33/1 C |
| 4,843,719 | A * | 7/1989 | Straten | B43L 9/04 | 33/27.02 |
| 5,383,276 | A * | 1/1995 | Izumi | B43L 13/002 | 33/1 AP |
| 5,894,671 | A * | 4/1999 | Karapetian | B43L 13/002 | 33/1 AP |
| 2003/0154608 | A1* | 8/2003 | Khan | B43L 9/04 | 33/27.03 |
| 2018/0229542 | A1* | 8/2018 | Salimi | B43L 13/205 | |

* cited by examiner

PLOTTER APPARATUS AND METHODS FOR DRAWING A POLYGON INSCRIBED WITHIN A CIRCLE

BACKGROUND OF THE INVENTION

Many jobs and occupations related to drawings use compasses when circles are needed to be drawn. But when the aim is to create patterns and templates, or achieve innovation of new artistic work, the use of regular geometric shapes is inevitable. However, for achieving such aims, specially designed tools are not available, since the aim is to use it in drawings as a ground for growing patterns. There are three different methods which are used to achieve this aim. In a first method, ready-made polygon stencils are used, but these stencils lack the desired dimensions, and for each polygon a special stencil should be prepared. Examples of such stencils are the triangle or pentagon stencils.

In a second method, a set of graphic geometric techniques are used for polygons, however geometrical techniques for each polygon are different, difficult and sometimes time-consuming. For example, the graphic technique for a pentagon might be completely different from a graphic technique required for an octagon. Besides, it might be difficult for a person with average skills to comprehend each method for each respective polygon.

The third method is the use of some trigonometric formulas for each polygon. However, due to using mathematical formulae, this method is not suitable and undesirable for users because geometric calculators are not considered as tools for artistic designers. Besides, most artists might not be trained in using mathematical formulas as a strategy to draw geometric shapes.

Therefore, there is a need for a tool that can resolve the above-mentioned problems. With such a tool, it will be possible to save time by quickly drawing various polygons in a variety of forms without the application of any complex mathematical formulae or principles. There is a need for a tool to draw polygons without the requirement of any other auxiliary tools, and to avoid learning a variety of geometric rules, where the tool can be used in drawings as a basis for growing patterns. The added advantage of such a single tool would be that there would be a considerable reduction in cost since other tools are not used to make the drawings.

SUMMARY OF THE INVENTION

This summary is provided to introduce a selection of concepts in a simplified form that are further disclosed in the detailed description of the invention. This summary is not intended to identify key or essential inventive concepts of the claimed subject matter, nor is it intended for determining the scope of the claimed subject matter.

The plotter apparatus disclosed herein is a tool which addresses the above-mentioned problems in the background. The plotter apparatus is configured to inscribe a polygon in a circle. The plotter apparatus comprises a ruler body, a first slider, a second slider, multiple brachiums, and a nib member. The ruler body comprises a knap extending substantially perpendicular from one end of the ruler body, and the ruler body further comprises a first ruler groove and a second ruler groove extending along a length of the ruler body. The first slider is configured to slide through the first ruler groove, and the knap and the first slider define a first mouth piece. The second slider is configured to slide through the second ruler groove, and the knap and the second slider define a second mouth piece.

The brachiums are pivotally connected across the ruler body. A first brachium is pivotally connected to the first slider at a first pivot, and a second brachium is pivotally connected to the first brachium at a second pivot. A distal end of the second brachium is pivotally connected to the ruler body at a third pivot, and a third brachium is pivotally connected on a length of the first brachium at a fourth pivot. The second brachium and third brachium comprise a series of predetermined holes designated with numbers in an arithmetic progression. A fourth brachium is selectively connected on one of the holes on the second brachium at a fifth pivot. The third brachium and the fourth brachium are connected at a sixth pivot defined by an intersection of the third brachium and the fourth brachium.

The nib member is configured to be positioned on the second slider, and the nib member is configured to draw the circle with the knap as a center. The first mouth piece is opened to enclose on a diameter of the circle, and the fourth brachium is attached to a predetermined numbered hole on the second brachium and the third brachium as per the number of sides required on the polygon. The second slider is positioned at an intersection of the fourth brachium and the first ruler groove to determine a length of each side of the polygon on the second mouth piece. Now cyclic arcs are drawn along the circumference of the circle with the determined length as a length of one side of the polygon, and the arc intersections on the circle are joined together to define the polygon. In one embodiment, the cyclic arcs are drawn along the circumference of the circle with the determined distance as the crest or edge of the polygon, and the arc intersections on the circle are joined together to define the polygon.

In an embodiment, the number of sides of the polygon are determined by pivotally connecting the fifth pivot of the fourth brachium to the selected predetermined hole on the second brachium, and pivotally connecting the sixth pivot to the selected predetermined hole in the third brachium. In an embodiment, a second slider guideline of the second slider is positioned at an intersection of a fourth brachium guideline and a ruler guideline defined by the first ruler groove, to obtain a length of each side of the polygon on the second mouth piece. In an embodiment, the plotter apparatus further comprises a knob positioned above the second pivot, and the knob is configured to be held by a user to draw the circle. In an embodiment, the nib member is axially aligned to the second slider guideline to determine the length of each side of the polygon on the second mouth piece. In an embodiment, the nib member is a marker or a pen attached to the second slider. In an embodiment, the ruler body further comprises a graded edge comprising a calibration, and the calibration enables a user to fix the diameter of the circle to inscribe the polygon in the circle.

One aspect of the present disclosure is directed to a plotter apparatus configured to inscribe a polygon in a circle, the plotter apparatus comprising: (a) a ruler body comprising a knap extending substantially perpendicular from one end of the ruler body, wherein the ruler body further comprises a first ruler groove and a second ruler groove extending along a length of the ruler body; (b) a first slider configured to slide through the first ruler groove, wherein the knap and the first slider define a first mouth piece; (c) a second slider configured to slide through the second ruler groove, wherein the knap and the second slider define a second mouth piece; (d) a plurality of brachiums pivotally connected across the ruler body, a first brachium pivotally connected to the first slider at a first pivot, and a second brachium pivotally connected to the first brachium at a second pivot, a distal end of the second brachium pivotally connected to the ruler body at a third pivot, a third brachium pivotally connected on a length of the first brachium at a fourth pivot, the second brachium and third brachium comprising a series of predetermined holes designated with numbers in arithmetic progression, a fourth brachium selectively connected on one of the holes on the second brachium at a fifth pivot, the third brachium and the fourth brachium connected at a sixth pivot defined by an intersection of the third brachium and the fourth brachium; and (e) a nib member configured to be positioned on the second slider, the nib member configured to draw the circle with the knap as a center, wherein the first mouth piece is opened to enclose on a diameter of the circle, and the fourth brachium is attached to a predetermined numbered hole on the second brachium and the third brachium according to the number of sides required on the polygon, and the second slider is positioned along an intersection of the fourth brachium and the first ruler groove to determine a length of each side of the polygon on the second mouth piece, wherein cyclic arcs are drawn along a circumference of the circle with the determined length as a length of one side of the polygon, wherein arc intersections on the circle are joined together to define the polygon. In one embodiment, the cyclic arcs are drawn along the circumference of the circle with the determined distance as the crest or edge of the polygon, and the arc intersections on the circle are joined together to define the polygon.

In one embodiment of the plotter apparatus, the number of sides of the polygon are determined by pivotally connecting the fifth pivot of the fourth brachium to the selected predetermined hole on the second brachium, and pivotally connecting the sixth pivot to the selected predetermined hole in the third brachium. In another embodiment, a second slider guideline of the second slider is positioned at an intersection of a fourth brachium guideline and a ruler guideline defined by the first ruler groove, to obtain a length of each side of the polygon on the second mouth piece. In one embodiment, the plotter apparatus further comprises a knob positioned above the second pivot, wherein the knob is configured to be held by a user to draw the circle. In a related embodiment, the nib member is axially aligned to the second slider guideline to determine the length of one side of the polygon on the second mouth piece. In one embodiment, the nib member is one of a marker and a pen attached to the second slider. In another embodiment, the ruler body further comprises a graded edge comprising a calibration, wherein the calibration enables a user to fix the diameter of the circle to inscribe the polygon in the circle.

Another aspect of the present disclosure is directed to a method of drawing a polygon inscribed within a circle, the method comprising: (a) providing a plotter apparatus comprising a ruler body, a first slider, a second slider, a plurality of brachiums, and a nib member; wherein the first slider configured to slide through the first ruler groove, wherein the knap and the first slider define a first mouth piece; wherein the second slider configured to slide through the second ruler groove, wherein the knap and the second slider define a second mouth piece; wherein the brachiums are pivotally connected across the ruler body, a first brachium pivotally connected to the first slider at a first pivot, and a second brachium pivotally connected to the first brachium at a second pivot, a distal end of the second brachium pivotally connected to the ruler body at a third pivot, a third brachium pivotally connected on a length of the first brachium at a fourth pivot, the second brachium and third brachium comprising a series of predetermined holes designated with numbers in arithmetic progression, a fourth brachium selectively connected on one of the holes on the second brachium at a fifth pivot, the third brachium and the fourth brachium connected at a sixth pivot defined by an intersection of the third brachium and the fourth brachium; and the nib member configured to be positioned on the second slider.

The method of drawing a polygon inscribed within a circle further comprises (b) drawing the circle with the knap as a center using the nib member; (c) attaching the fourth brachium to a predetermined numbered hole on the second brachium and the third brachium according to the number of sides required on the polygon; (d) opening the first mouth piece to enclose on a diameter of the circle; (e) positioning the second slider at an intersection of the fourth brachium and the first ruler groove to determine a length of each side of the polygon on the second mouth piece; (f) drawing cyclic arcs with the determined length as a length of one side of the polygon along a circumference of the circle; and (g) joining the arc intersections on the circle to define the polygon. In one embodiment, steps (c) and (d) as outlined above are reversed in order; that is, step (d) is performed first (after step (b)) and then step (c).

BRIEF DESCRIPTION OF THE DRAWINGS

The foregoing summary, as well as the following detailed description of the invention, is better understood when read in conjunction with the appended drawings. For the purpose of illustrating the invention, exemplary constructions of the invention are shown in the drawings. However, the invention is not limited to the specific methods and components disclosed herein.

DETAILED DESCRIPTION

The present invention generally relates to a device used in drawing polygons in the field of fine arts, and more particularly relates to a plotter apparatus configured to inscribe a polygon inside a circle.

Figure 1:
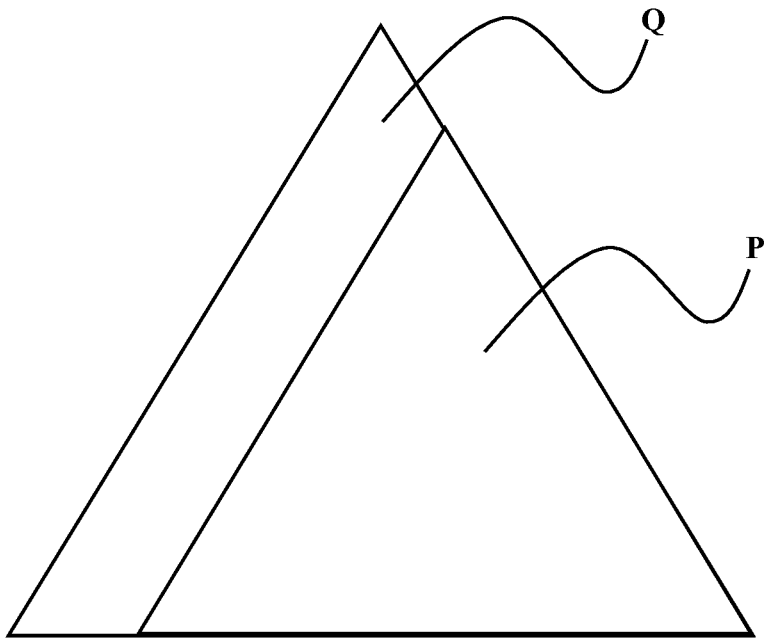
FIG. 1 exemplarily illustrates a first triangle P positioned within a second triangle Q to describe the principle of working of the plotter apparatus.

FIG. 1 exemplarily illustrates a first triangle P positioned within a second triangle Q to describe the principle of working of the plotter apparatus 100. To describe the principle of operation of the plotter apparatus 100, for a circle with radius "R", the length of each side will be equal to "L" if we consider a polygon 300. This length of each side "L" for example is for polygon with 3 sides that is contrived on hole by number "3" on the second and third brachiums. Therefore, $L=2\times R\times \sin(360/2\times n)$; where L=length of each side of desired polygon, R=circle radius, and n=number of sides of desired polygon. Now, a solution to obtain the "L" for polygon with variable radius is derived which allows a user to multiply the obtained "L" by the desired dimensions so that the user can inscribe the obtained result in a desired circumscribed circle. For this purpose, the rules governing trigonometric similarity are used. In other words, the two triangles P and Q, with their respective predetermined proportions are considered as the basis of a scale factor. As shown in FIG. 1, the triangle Q is multiplied by "X" times the dimensions to obtain the triangle P. Thus, the base side of the triangle P is equal to "X" times the base size of the triangle Q. Other intended proportion amounts may be obtained by generalizing this method and multiplying the triangle Q in the desired numbers of X1, X2, X3, etc. This principle is used in the working of the plotter apparatus 100, where the multiple brachiums 104 are represented by the identical triangles P and Q.

Figure 2:
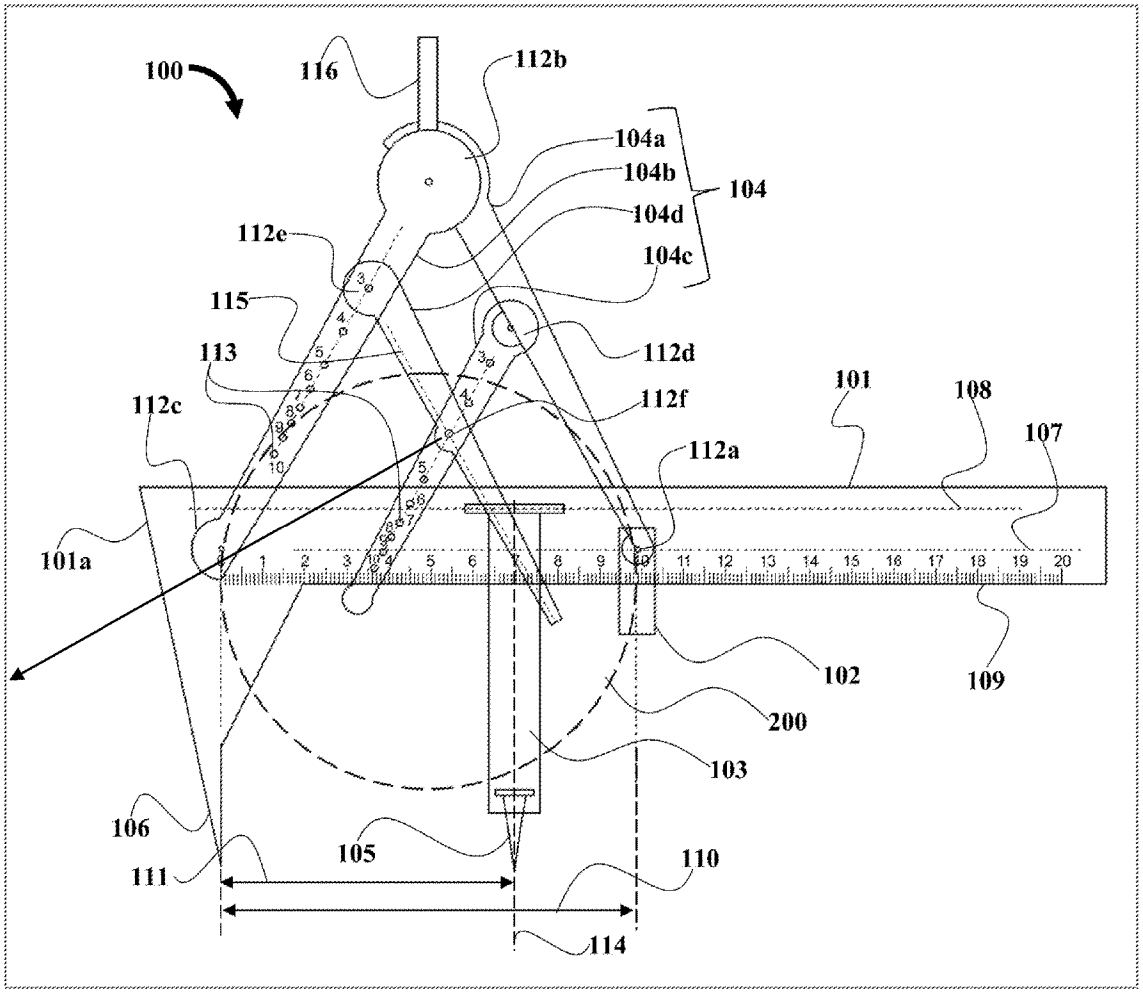
FIG. 2 exemplarily illustrates a front perspective view of the plotter apparatus positioned over a circle to enclose the diameter of the circle.

FIG. 2 exemplarily illustrates a front perspective view of the plotter apparatus 100 positioned over a circle 200 to enclose the diameter of the circle 200. The plotter apparatus 100 is configured to inscribe a polygon 300 in a circle 200 and uses the principle of similar triangles P and Q used in FIG. 1. The plotter apparatus 100 comprises a ruler body 101, a first slider 102, a second slider 103, multiple brachiums 104, and a nib member 105. The ruler body 101 comprises a knap 106 extending substantially perpendicular from one end 101*a* of the ruler body 101. The ruler body 101 further comprises a first ruler groove 107 and a second ruler groove 108 extending along a length of the ruler body 101. In an embodiment, the ruler body 101 further comprises a graded edge 109 comprising a calibration, and the calibration enables a user to fix the diameter of the circle 200 to inscribe the polygon 300 in the circle 200. The first slider 102 is configured to slide through the first ruler groove 107, and the knap 106 and the first slider 102 define a first mouth piece 110. The second slider 103 is configured to slide through the second ruler groove 108, and the knap 106 and the second slider 103 define a second mouth piece 111.

The brachiums 104 are pivotally connected across the ruler body 101. A first brachium 104*a* is pivotally connected to the first slider 102 at a first pivot 112*a*, and a second brachium 104*b* is pivotally connected to the first brachium 104*a* at a second pivot 112*b*. A distal end of the second brachium 104*b* is pivotally connected to the ruler body 101 at a third pivot 112*c*, and a third brachium 104*c* is pivotally connected on a length of the first brachium 104*a* at a fourth pivot 112*d*. The second brachium 104*b* and third brachium 104*c* comprises a series of predetermined holes 113 designated with numbers in arithmetic progression. A fourth brachium 104*d* is selectively connected on one of the holes 113 on the second brachium 104*b* at a fifth pivot 112*e*. The third brachium 104*c* and the fourth brachium 104*d* are connected at a sixth pivot 112*f* defined by an intersection of the third brachium 104*c* and the fourth brachium 104*d*.

The nib member 105 is configured to be positioned on the second slider 103, and the nib member 105 is configured to draw the circle 200 with the knap 106 as a center. In other words, at first, we draw a circle 200 with a specified diameter, and here the knap 106 allows the plotter apparatus 100 to be used as a compass. The graded edge 109 with the calibration allows the user to determine the desired diameter of the circle 200. The nib member 105 can be a pencil or a marker. The first mouth piece 110 is opened to enclose on a diameter of the circle 200, and the fourth brachium 104*d* is attached to a predetermined numbered hole 113 on the second brachium 104*b* and the third brachium 104*c* as per the number of sides required on the polygon 300. The second slider 103 is positioned at an intersection of the fourth brachium 104*d* and the first ruler groove 107 to determine a length of each side of the polygon 300 on the second mouth piece 111. Now, as disclosed in the FIG. 3, cyclic arcs 118 are drawn along the circumference of the circle 200 with the determined length as a length of one side of the polygon 300, and the arc intersections 117 on the circle 200 are joined together to define the polygon 300.

In an embodiment, the number of sides of the polygon 300 are determined by pivotally connecting the fifth pivot 112*e* of the fourth brachium 104*d* to the selected predetermined hole 113 on the second brachium 104*b*, and pivotally connecting the sixth pivot 112*f* to the selected predetermined hole 113 in the third brachium 104*c*. In an embodiment, a second slider guideline 114 of the second slider 103 is positioned at an intersection of a fourth brachium guideline 115 and a ruler guideline defined by the first ruler groove 107, to obtain a length of each side of the polygon 300 on the second mouth piece 111. In an embodiment, the plotter apparatus 100 further comprises a knob 116 positioned above the second pivot 112*b*, and the knob 116 is configured to be held by a user to draw the circle 200. In an embodiment, the nib member 105 is a marker or a pen attached to the second slider 103.

One aspect of the present disclosure is directed to a plotter apparatus 100 configured to inscribe a polygon 300 in a circle 200. The plotter apparatus 100 comprises a ruler body 101 comprising a knap 106 extending substantially perpendicular from one end of the ruler body 101, wherein the ruler body 101 further comprises a first ruler groove 107 and a second ruler groove 108 extending along a length of the ruler body 101; a first slider 102 configured to slide through the first ruler groove 107, wherein the knap 106 and the first slider 102 define a first mouth piece 110; and a second slider 103 configured to slide through the second ruler groove 108, wherein the knap 106 and the second slider 103 define a second mouth piece 111.

The plotter apparatus 100 further comprises a plurality of brachiums 104 pivotally connected across the ruler body 101, a first brachium 104*a* pivotally connected to the first slider 102 at a first pivot 112*a*, and a second brachium 104*b* pivotally connected to the first brachium 104*a* at a second pivot 112*b*, a distal end of the second brachium 104*b* pivotally connected to the ruler body 101 at a third pivot 112*c*, a third brachium 104*c* pivotally connected on a length of the first brachium 104*a* at a fourth pivot 112*d*, the second brachium 104*b* and third brachium 104*c* comprising a series of predetermined holes 113 designated with numbers in arithmetic progression, a fourth brachium 104*d* selectively connected on one of the holes 113 on the second brachium 104*b* at a fifth pivot 112*e*, the third brachium 104*c* and the fourth brachium 104*d* connected at a sixth pivot 112*f* defined by an intersection of the third brachium 104*c* and the fourth brachium 104*d*.

The plotter apparatus 100 further comprises a nib member 105 configured to be positioned on the second slider 103, the nib member 105 configured to draw the circle 200 with the knap 106 as a center, wherein the first mouth piece 110 is opened to enclose on a diameter of the circle 200, and the fourth brachium 104*d* is attached to a predetermined numbered hole 113 on the second brachium 104*b* and the third brachium 104*c* according to the number of sides required on the polygon 300, and the second slider 103 is positioned along an intersection of the fourth brachium 104*d* and the first ruler groove 107 to determine a length of each side of the polygon 300 on the second mouth piece 111, wherein cyclic arcs 118 are drawn along a circumference of the circle 200 with the determined length as a length of one side of the polygon 300, wherein arc intersections 117 on the circle 200 are joined together to define the polygon 300. In one embodiment, the cyclic arcs 118 are drawn along the circumference of the circle 200 with the determined distance as the crest or edge of the polygon 300, and the arc intersections 117 on the circle 200 are joined together to define the polygon 300.

For the plotter apparatus 100, the number of sides of the polygon 300 are determined by pivotally connecting the fifth pivot 112*e* of the fourth brachium 104*d* to the selected predetermined hole 113 on the second brachium 104*b*, and pivotally connecting the sixth pivot 112*f* to the selected predetermined hole 113 in the third brachium 104*c*. A second slider guideline 114 of the second slider 103 may be positioned at an intersection of a fourth brachium guideline 115 and a ruler guideline defined by the first ruler groove 107, to obtain a length of each side of the polygon 300 on the second mouth piece 111. The plotter apparatus 100 may further comprise a knob 116 positioned above the second pivot 112*b*, wherein the knob 116 is configured to be held by a user to draw the circle 200.

The nib member 105 may be axially aligned to the second slider 103 guideline to determine the length of one side of the polygon 300 on the second mouth piece 111. The nib member 105 may be one of a marker and a pen attached to the second slider 103. The ruler body 101 may further comprise a graded edge 109 comprising a calibration, wherein the calibration enables a user to fix the diameter of the circle 200 to inscribe the polygon 300 in the circle 200.

Figure 3:
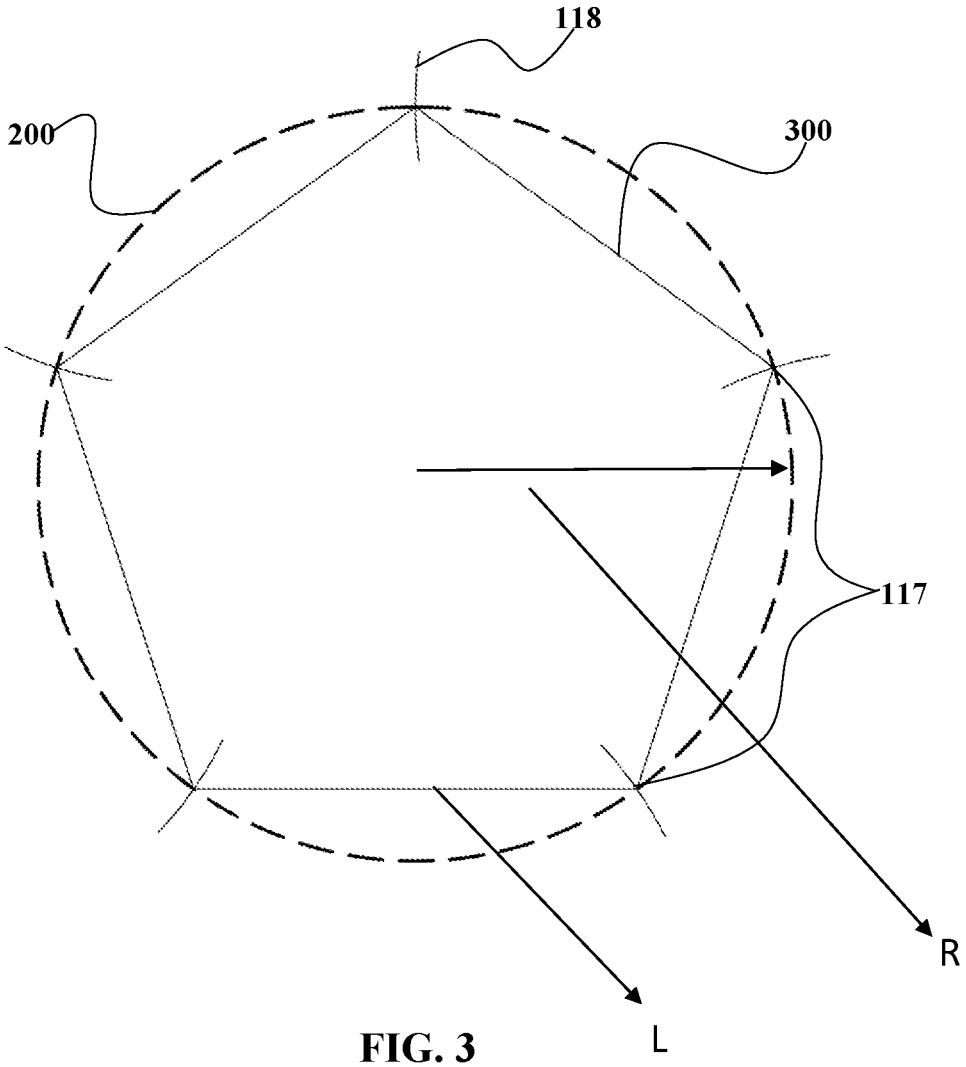
FIG. 3 exemplarily illustrates a front perspective view of the polygon formed by joining the arc intersections on the circumference of the circle.

FIG. 3 exemplarily illustrates a front perspective view of the polygon 300 formed by joining the arc intersections 117 on the circumference of the circle 200. After following the method of operation in FIG. 2, a user is enabled to obtain the length of one side of the polygon 300 by checking the length of the second mouthpiece 111. Similarly, with the help of the second slider 103, the user can mark the cyclic arcs 118 of the required polygon 300 on the circle 200 using the plotter apparatus 100, to specify the vertexes of the polygon 300 on the circle 200. As shown in the FIG. 3, the user can attach the vertexes using ruler body 101 and complete the polygon 300, for example, the polygon 300 as shown in FIG. 3.

The plotter apparatus 100 solves the problem of carrying various extra tools in a way that with just one tool, it is possible to quickly draw various polygons 300 in desired forms. It is also easy to work with the plotter apparatus 100 and does not require the knowledge of any geometrical rules and formula. The plotter apparatus 100 can be used to draw a variety of polygons 300 in different desired dimensions which makes it a cheap alternative for the use of multiple tools. The plotter apparatus 100 avoids drawing complexities, geometrical rules and principles for drawing polygons 300, especially when an artist is involved in using the plotter apparatus 100. The plotter apparatus 100 allows quick drawing periods and therefore saves time, since no other auxiliary tools are needed in drawing the polygon 300.

Another aspect of the present disclosure is directed to a method of drawing a polygon 300 inscribed within a circle 200. The method comprises providing a plotter apparatus 100 comprising a ruler body 101, a first slider 102, a second slider 103, a plurality of brachiums 104, and a nib member 105; wherein the first slider 102 is configured to slide through the first ruler groove 107, wherein a knap 106 and the first slider 102 define a first mouth piece 110; wherein the second slider 103 is configured to slide through the second ruler groove, wherein the knap 106 and the second slider 103 define a second mouth piece 111. The brachium 104 are pivotally connected across the ruler body 101, a first brachium 104*a* is pivotally connected to the first slider 102 at a first pivot 112*a*, and a second brachium 104*b* is pivotally connected to the first brachium 104*a* at a second pivot 112*b*. A distal end of the second brachium 104*b* is pivotally connected to the ruler body 101 at a third pivot 112*c*, a third brachium 104*c* is pivotally connected on a length of the first brachium 104*a* at a fourth pivot 112*d*. The second brachium 104*b* and third brachium 104*c* comprises a series of predetermined holes 113 designated with numbers in arithmetic progression. A fourth brachium 104*d* is selectively connected on one of the holes 113 on the second brachium 104*b* at a fifth pivot 112*e*. The third brachium 104*c* and the fourth brachium 104*d* are connected at a sixth pivot 112*f* defined by an intersection of the third brachium 104*c* and the fourth brachium 104*d*, and the nib member 105 is configured to be positioned on the second slider 103.

The method may further comprise drawing the circle 200 with the knap 106 as a center using the nib member 105; opening the first mouth piece 110 to enclose on a diameter of the circle 200; and attaching the fourth brachium 104*d* to a predetermined numbered hole 113 on the second brachium 104*b* and the third brachium 104*c* according to the number of sides required on the polygon 300. The method may further comprise positioning the second slider 103 at an intersection of the fourth brachium 104*d* and the first ruler groove 107 to determine a length of each side of the polygon 300 on the second mouth piece 111. The method may further comprise drawing cyclic arcs 118 with the determined length as a length of one side of the polygon 300 along a circumference of the circle 200; and joining the arc intersections 117 on the circle 200 to define the polygon 300.

The foregoing examples have been provided merely for the purpose of explanation and are in no way to be construed as limiting of the present concept disclosed herein. While the concept has been described with reference to various embodiments, it is understood that the words, which have been used herein, are words of description and illustration, rather than words of limitation. Further, although the concept has been described herein with reference to particular means, materials, and embodiments, the concept is not intended to be limited to the particulars disclosed herein; rather, the concept extends to all functionally equivalent structures, methods and uses, such as are within the scope of the appended claims. Those skilled in the art, having the benefit of the teachings of this specification, may affect numerous modifications thereto and changes may be made without departing from the scope and spirit of the concept in its aspects.

The invention claimed is:

1. A plotter apparatus configured to inscribe a polygon in a circle, the plotter apparatus comprising;

a ruler body comprising a knap extending substantially perpendicular from one end of the ruler body, wherein the ruler body further comprises a first ruler groove and a second ruler groove extending along a length of the ruler body;

a first slider configured to slide through the first ruler groove, wherein the knap and the first slider define a first mouth piece;

a second slider configured to slide through the second ruler groove, wherein the knap and the second slider define a second mouth piece;

a plurality of brachiums pivotally connected across the ruler body, a first brachium pivotally connected to the first slider at a first pivot, and a second brachium pivotally connected to the first brachium at a second pivot, a distal end of the second brachium pivotally connected to the ruler body at a third pivot, a third brachium pivotally connected on a length of the first brachium at a fourth pivot, the second brachium and third brachium comprising a series of predetermined holes designated with numbers in arithmetic progression, a fourth brachium selectively connected on one of the holes on the second brachium at a fifth pivot, the third brachium and the fourth brachium connected at a sixth pivot defined by an intersection of the third brachium and the fourth brachium; and a nib member configured to be positioned on the second slider, the nib member configured to draw the circle with the knap as a center, wherein the first mouth piece is opened to enclose on a diameter of the circle, and the fourth brachium is attached to a predetermined numbered hole on the second brachium and the third brachium according to the number of sides required on the polygon, and the second slider is positioned along an intersection of the fourth brachium and the first ruler groove to determine a length of each side of the polygon on the second mouth piece, wherein cyclic arcs are drawn along a circumference of the circle with the determined length as a length of one side of the polygon, wherein arc intersections on the circle are joined together to define the polygon.

2. The plotter apparatus of claim 1, wherein number of sides of the polygon are determined by pivotally connecting the fifth pivot of the fourth brachium to the selected predetermined hole on the second brachium, and pivotally connecting the sixth pivot to the selected predetermined hole in the third brachium.

3. The plotter apparatus of claim 1, wherein a second slider guideline of the second slider is positioned at an intersection of a fourth brachium guideline and a ruler guideline defined by the first ruler groove, to obtain a length of each side of the polygon on the second mouth piece.

4. The plotter apparatus of claim 3, wherein the nib member is axially aligned to the second slider guideline to determine the length of one side of the polygon on the second mouth piece.

5. The plotter apparatus of claim 1, further comprising a knob positioned above the second pivot, wherein the knob is configured to be held by a user to draw the circle.

6. The plotter apparatus of claim 1, wherein the nib member is one of a marker and a pen attached to the second slider.

7. The plotter apparatus of claim 1, wherein the ruler body further comprises a graded edge comprising a calibration, wherein the calibration enables a user to fix the diameter of the circle to inscribe the polygon in the circle.

8. A method of drawing a polygon inscribed within a circle, the method comprising;

providing a plotter apparatus comprising a ruler body, a first slider, a second slider, a plurality of brachiums, and a nib member;

the first slider configured to slide through a first ruler groove, wherein the knap and the first slider define a first mouth piece;

the second slider configured to slide through a second ruler groove, wherein the knap and the second slider define a second mouth piece;

the brachiums pivotally connected across the ruler body, a first brachium pivotally connected to the first slider at a first pivot, and a second brachium pivotally connected to the first brachium at a second pivot, a distal end of the second brachium pivotally connected to the ruler body at a third pivot, a third brachium pivotally connected on a length of the first brachium at a fourth pivot, the second brachium and third brachium comprising a series of predetermined holes designated with numbers in arithmetic progression, a fourth brachium selectively connected on one of the holes on the second brachium at a fifth pivot, the third brachium and the fourth brachium connected at a sixth pivot defined by an intersection of the third brachium and the fourth brachium; and the nib member configured to be positioned on the second slider;

drawing the circle with the knap as a center using the nib member;

attaching the fourth brachium to a predetermined numbered hole on the second brachium and the third brachium according to the number of sides required on the polygon;

opening the first mouth piece to enclose on a diameter of the circle;

positioning the second slider at an intersection of the fourth brachium and the first ruler groove to determine a length of each side of the polygon on the second mouth piece;

drawing cyclic arcs with the determined length as a length of one side of the polygon along a circumference of the circle; and joining the arc intersections on the circle to define the polygon.

* * * * *